US010801218B2

(12) United States Patent
Cipriani

(10) Patent No.: US 10,801,218 B2
(45) Date of Patent: Oct. 13, 2020

(54) LEVELING DEVICE FOR TILES

(71) Applicant: Termoplast S.R.L, Verona (IT)

(72) Inventor: Giulio Cipriani, Verona (IT)

(73) Assignee: Termoplast S.R.L., Verona (IT)

( * ) Notice: Subject to any disclaimer, the term of this patent is extended or adjusted under 35 U.S.C. 154(b) by 205 days.

(21) Appl. No.: 16/095,779

(22) PCT Filed: May 12, 2017

(86) PCT No.: PCT/IB2017/052791
§ 371 (c)(1),
(2) Date: Oct. 23, 2018

(87) PCT Pub. No.: WO2017/195155
PCT Pub. Date: Nov. 16, 2017

(65) Prior Publication Data

US 2019/0127994 A1 May 2, 2019

(30) Foreign Application Priority Data

May 12, 2016 (IT) ..... 102016000049077

(51) Int. Cl.
*E04F 21/18* (2006.01)
*E04F 21/00* (2006.01)
*E04F 15/02* (2006.01)

(52) U.S. Cl.
CPC .... *E04F 21/1877* (2013.01); *E04F 15/02022* (2013.01); *E04F 21/0092* (2013.01)

(58) Field of Classification Search
CPC ... E04F 21/1877; E04F 21/0092; E04F 21/20; E04F 15/02022
USPC ..... 33/526, 527; 52/749.11, 747.11
See application file for complete search history.

(56) References Cited

U.S. PATENT DOCUMENTS 7,861,487 B2 * 1/2011 Kufner ..... E04F 15/02022 52/749.11
8,181,420 B2 * 5/2012 Torrents I Comas ..... E04F 21/0092 52/749.11
8,429,878 B1 * 4/2013 Hoffman ..... E04F 13/0889 52/747.11
8,429,879 B1 * 4/2013 Hoffman ..... E04F 21/0092 52/747.11
9,279,259 B1 * 3/2016 Russo ..... E04F 21/20
9,482,019 B2 * 11/2016 Fontana ..... E04F 13/0892
10,538,925 B2 * 1/2020 Ghelfi ..... E04F 21/1877
2013/0067854 A1 * 3/2013 Bordin ..... E04F 21/0092 52/749.11
2014/0033641 A1 * 2/2014 Trevisi ..... E04F 21/0092 52/749.1
2015/0211243 A1 * 7/2015 Irvine ..... E04F 21/22 52/126.1
2015/0354231 A1 * 12/2015 Bordin ..... E04F 21/0092 52/126.6
2018/0100315 A1 * 4/2018 Volponi ..... E04F 21/0092
(Continued)

FOREIGN PATENT DOCUMENTS

WO WO-2013023236 A1 * 2/2013 ..... E04F 21/0092
WO WO-2016201502 A1 * 12/2016 ..... E04F 21/22

*Primary Examiner* — Christopher W Fulton
(74) *Attorney, Agent, or Firm* — Bond, Schoeneck & King, PLLC; Joseph Noto

(57) ABSTRACT

This is a leveling device that is capable to bring to the same level two or more tiles with which the leveling device is placed in contact.

9 Claims, 5 Drawing Sheets

(56) References Cited

U.S. PATENT DOCUMENTS

2018/0148939 A1* 5/2018 Sighinolfi ..... E04F 21/20

* cited by examiner

LEVELING DEVICE FOR TILES

REFERENCE TO RELATED APPLICATION

This application is a U.S. National Phase filing of International Application No. PCT/IB2017/052791, filed May 12, 2017, which relates and claims priority to Italian Application Number 102016000049077, filed May 12, 2016, the entirety of each of which are hereby incorporated by reference in their entirety.

FIELD

The present invention refers, in general, to a leveling device for tiles. In particular, the present invention refers to a leveling device that is capable to bring to the same level two or more tiles with which the leveling device is placed in contact.

BACKGROUND

As is known, there are many types of leveling devices for tiles, these levelers being capable to bring the upper surfaces of a plurality of tiles to the same plane.

Indeed, in the laying of floorings or tiled walls, tiles are often glued to base supports that are not always perfectly planar because of the irregularity in the distribution of the adhesive agent or because of the irregularity of the bottom.

For not only aesthetic requirements, in order to make coplanar the upper surfaces of the tiles, levelers are used.

A type of levelers is that illustrated, for example, in the patent documents US2006/185269A1, U.S. Pat. No. 8,429,879 B1 and US2014/283401.

This type of levelers comprises two elements, namely a support and a pressing body.

The support has a support base and an elongated body that extends orthogonally from the base and has side protrusions.

The pressing body has a base in which a hole is formed which has recesses which are arranged at regular intervals in height.

The method of using levelers of this type requires that the base be laid on the adhesive and that two or more tiles be positioned on it. The positioning of the base is carried out in such a way that the edges of two adjacent tiles are in abutment on the elongated body so that these tiles remain separated at a wished distance and form the so-called joint.

Subsequently, the pressing body is coupled to the support by putting the elongated body into the hole of the pressing body.

The shape of the side protrusions of the elongated body and the shape of the recesses formed into the hole cause that the pressing body can be pushed downwards but can not be removed upwards from the elongated body.

The pressing body is moved downwards as long as the base is in contact with the tiles. Pushing forcefully onto the pressing body, the base brings the upper surfaces of the tiles, and consequently the tiles, to the same height, on which tiles the pressing body abuts.

Once the glue has dried and the tiles are fixed to the base support by means of the glue, the elongated body and the pressing body fixed to it are removed by forcing the breakage of the support, and separating the elongated body from the base which remains definitively under the tiles.

Said breakage is generally facilitated by the presence of a predefined breakage invitation formed in the junction between the base and the elongated body.

Naturally, also the elongated body, once it is separated from the base, is no more reusable, so that the support is a so-called disposable element.

On the contrary, the pressing body is recovered and can continue its run on the elongated body until the elongated body slips off. Obviously, the direction of the run of the elongated body remains only one because of the shapes of the previously defined protrusions and recesses.

Levelers of this type present some problems, in particular as regards ease, speed and convenience of use.

Indeed, when the base of the pressing body has to exercise the due pressure on the tiles in order to level the tiles to each other, it is necessary to use a tool, for example a pair of pliers, so as to obtain a proper push.

Anyway, said operation is not so simple and convenient, even using the appropriate tools.

Another problem in using levelers of this type lies in the times of use; in fact, even a phase of simple displacement of the pressing body relative to the elongated body involves a certain pressure and entails a waste of time that, while being minimal if considered for one leveler, becomes a significant waste of time if considered for a plurality of levelers to be used for a tiled surface.

Another problem in the levelers of the prior art is the lack of a precise adjustment in the pressing phase. Indeed, the protrusions in the elongated body are arranged at regular intervals so that the pressing body has a free displacement in a space interval equal to the distance between neighbouring protrusions even when the pressing body is in abutment on the tiles.

SUMMARY

An object of the present invention is to provide a leveling device solving the so-described problems and other problems of the known systems.

Another object of this invention is to produce a leveling device that can be used easily and quickly.

Another object of the invention is to provide a leveling device having a precise adjustment in the pressing phase on the tiles.

All the so-described objects and still other objects are achieved through a leveling device suitable for being used by a user for laying on a plane and leveling at least two adjacent tiles.

DETAILED DESCRIPTION

The leveling device comprises a support suitable for being bounded below the tiles and a pressing body placed above the tiles and adapted to be movably constrained to the support and to abut and press on at least two tiles.

The support comprises a base suitable for being disposed under the at least two adjacent tiles, and an elongated body that extends orthogonally to the base and comprises first gripping means.

The pressing body has a central longitudinal axis and is suitable for being movably fastened to the support; in particular, the pressing body comprises a bearing structure with a lower edge adapted to abut on at least one of the at least two tiles; a hole being formed in the bearing structure so as to receive the elongated body that can translate freely.

The leveling device can further comprise at least one fin and at least one arcuate body, the fin and the arcuate body being shaped in a particular way.

The one or more fins are fixed elastically to the bearing structure and are adapted to be pressed by the user so as to be moved from a rest position when the fin is not pressed to a release position when the fin is pressed.

The one or more arcuate bodies are fixed elastically to the bearing structure, are connected to the respective fin and include second gripping means.

The first gripping means and the second gripping means are shaped in a homologous way so as to be coupled with one another.

In this way, when the elongated body is inserted into the hole and the one or more fins are in a rest position, the one or more arcuate bodies abut on the elongated body and couple the first gripping means and the second gripping means to one another so as to avoid a free translation of the pressing body relative to the support.

On the contrary, when the elongated body is inserted into the hole and the one or more fins are in the release position, the respective arcuate body is moved away from the elongated body and the first gripping means and the second gripping means are not coupled to one another so as to enable the pressing body to freely translate relative to the support.

Consequently, the leveling device according to the invention acts comfortably on the one or more fins so as to allow a fast and easy coupling and decoupling of the pressing body from the support so that the pressing body can translate without constraints with respect to the support.

This aspect is of great benefit when once the elongated body is inserted in the hole formed in the elongated body, the pressing body has to be quickly brought in abutment on the tiles and pressed on the tiles.

A similar advantage is obtained when the pressing body has to be quickly disengaged from the elongated body, after the tiles have been fixed to the ground and the pressing body together with the remaining part of the support has been separated from the base of the support.

The leveling device according to the invention may provide that the first gripping means of the elongated body include a thread and the second gripping means of the at least one arcuate body include a counter-thread, homologous to the thread, so that the elongated body can be screwed and unscrewed in the at least one arcuate body.

The presence of the thread and counter-thread allows to obtain an optimal adjustment of the pressing body with respect to the support, in particular allowing to exert a pressure on the tiles just rotating the pressing body.

Besides, the pressing body may comprise a first fin and a second fin which are elastically fixed to the bearing structure and are arranged above opposite to each other with respect to the central axis of the pressing body.

Through said position, it is possible to easily act on the fins by opposing the force of the thumb and the index of the hand that grabs the pressing body.

The pressing body may comprise a first arcuate body and a second arcuate body which are fixed elastically to the bearing structure and arranged opposite to each other with respect to the central axis of the pressing body. In this way, there are two elements acting in an opposite position on the elongated body, so that the gripping and possible coupling is improved.

Advantageously, an end of a first arm and an end of a second arm are fixed to the first fin, and an end of a third arm and an end of a fourth arm are fixed to the second fin. The opposite end of the first arm and the opposite end of the third arm are joined together and to a first cross member fixed to the first arcuate body while the opposite end of the second arm and the opposite end of the fourth arm are joined together and to a second cross member fixed to the second arcuate body.

In this way, the displacement of the fins causes the movement of the arms and relative cross members, so that the arcuate bodies are translated. Through this articulation it is sufficient a slight force on the fins to move the arcuate bodies.

Advantageously, the first cross member may develop downwards by means of a first projection so as to touch a first plane coplanar to the lying plane of the lower edge of the pressing body, and the second cross member may develop downwards by means of a second projection so as to touch a first plane coplanar to the lying plane of the lower edge of the pressing body.

In this way, when the pressing body presses on one or more tiles for their leveling, also the projections abut on the tiles and since they form an only body with the respective cross members, guarantee a continuous coupling of the coupling means such as the threads, the arcuate bodies and the elongated body.

The bearing structure may include a support disk disposed internally and at half height of the entire bearing structure, a first half-cylinder and a second half-cylinder extending downwards from the support disk so as to touch a second plane coplanar to the lying plane of the lower edge of the pressing body.

Said half-cylinders strengthen the effect obtained by the projections.

In order to facilitate the gripping of the pressing body and the use of the leveling device, the bearing structure includes a cylindrical body in whose upper portion a first opening and a second opening are formed in which the first fin and the second fin are arranged, respectively.

The leveling device according to the invention may provide that one or more reliefs are disposed on the outer surface of the cylindrical body to facilitate the gripping of the pressing body and its rotation by the user.

In order that the support can act also as a template for the formation of the joints, the elongated body may be joined to the base through a portal that develops orthogonally to the base.

Further features and details can be better understood from the following specification, provided by way of a non-limiting embodiment, as well as from the annexed drawings wherein:

BRIEF DESCRIPTION OF THE DRAWINGS

With reference to FIGS. 1 and 2, number 10 denotes a leveling device comprising a support 12 and a pressing body 14.

Figure 2:
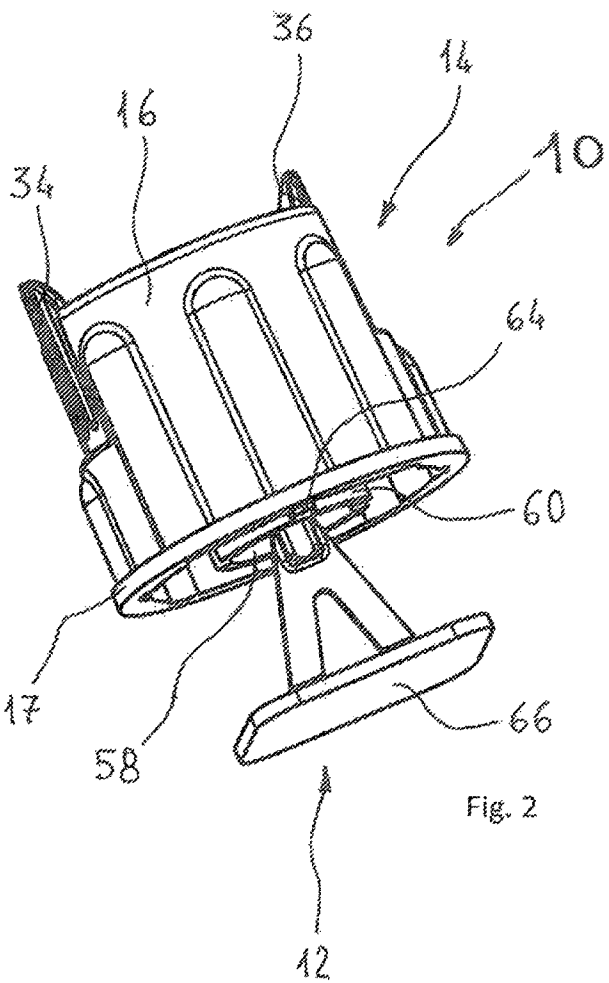
FIGS. 1 and 2 are two axonometric views of a leveling device, made according to the invention.

The pressing body 14 includes an internally hollow cylindrical body 16 provided with a lower edge 17 and reliefs 18 arranged at angular intervals on the outer surface of the cylindrical body 16.

A first opening 20 and a second opening 22 are formed in the upper portion of the cylindrical body 16 and are opposite to each other at an angular distance of 180 degree to each other.

Figure 6:
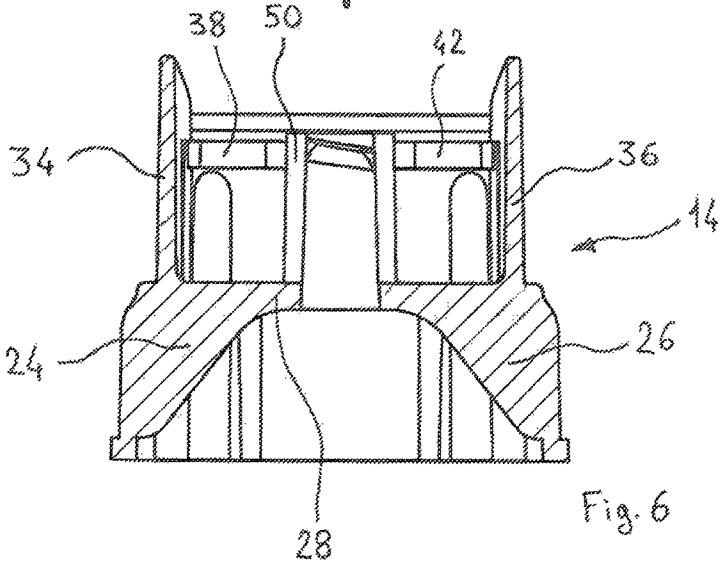
FIG. 6 is a view in section of the element in FIG. 3 according to plane B-B in FIG. 5.
Figure 3:
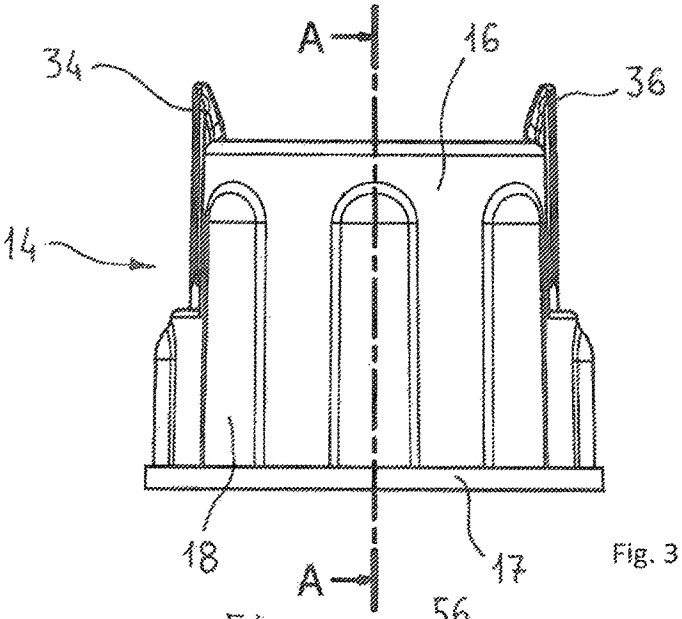
FIG. 3 is a side view of a first element of the leveling device in FIG. 1.
Figure 7:
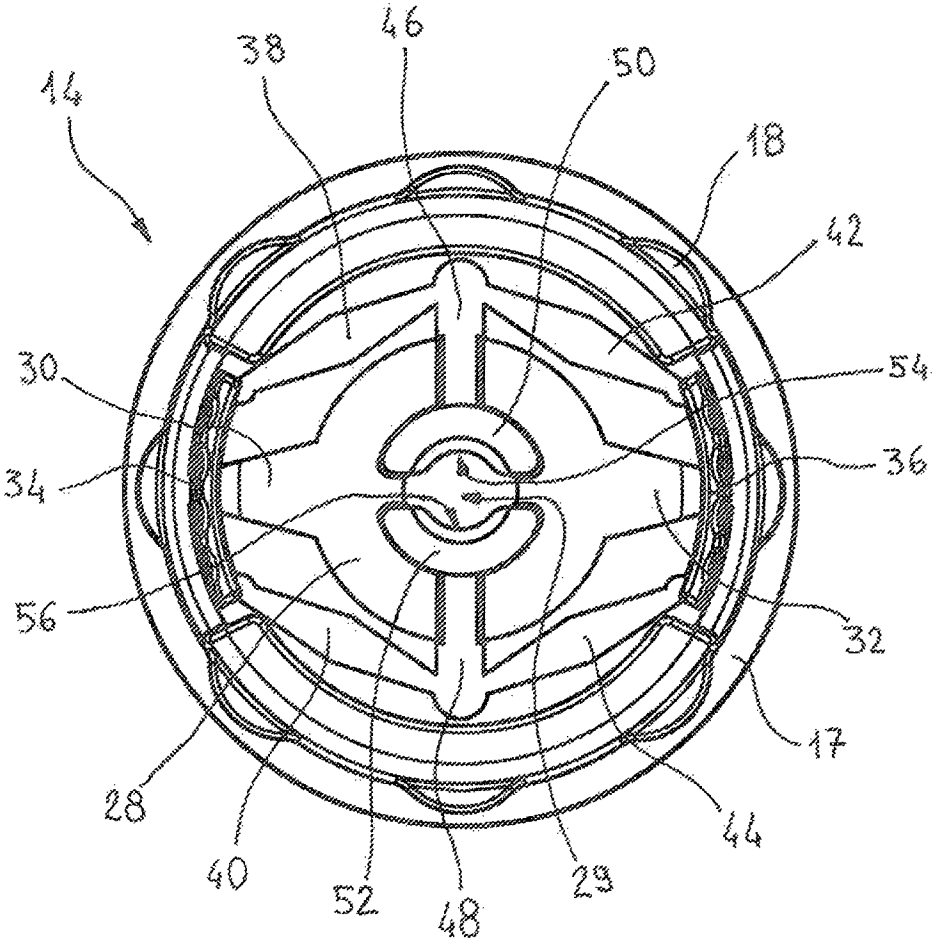
FIG. 7 is a top view of the element in FIG. 1.

As shown in FIG. 6, a first shoulder 24 and a second shoulder 26 are arranged internally to the cylindrical body 16, in its lower portion, and develop on a common plane starting from the inner surface and connecting to a support disk 28 also visible in FIG. 7, the two shoulders being symmetric to each other with respect to the central axis of the pressing body 14.

The first shoulder 24 and the second shoulder 26 support, on the upper part, a first triangular portion 30 and a second triangular portion 32, respectively. Both triangular portions are protruding from the support disk 28 in opposite directions.

A first fin 34 and a second fin 36 are joined to the first triangular portion 30 and the second triangular potion 32, respectively. These fins have an arcuate shape and develop in an orthogonal direction with respect to the triangular portions 30, 32.

Figure 1:
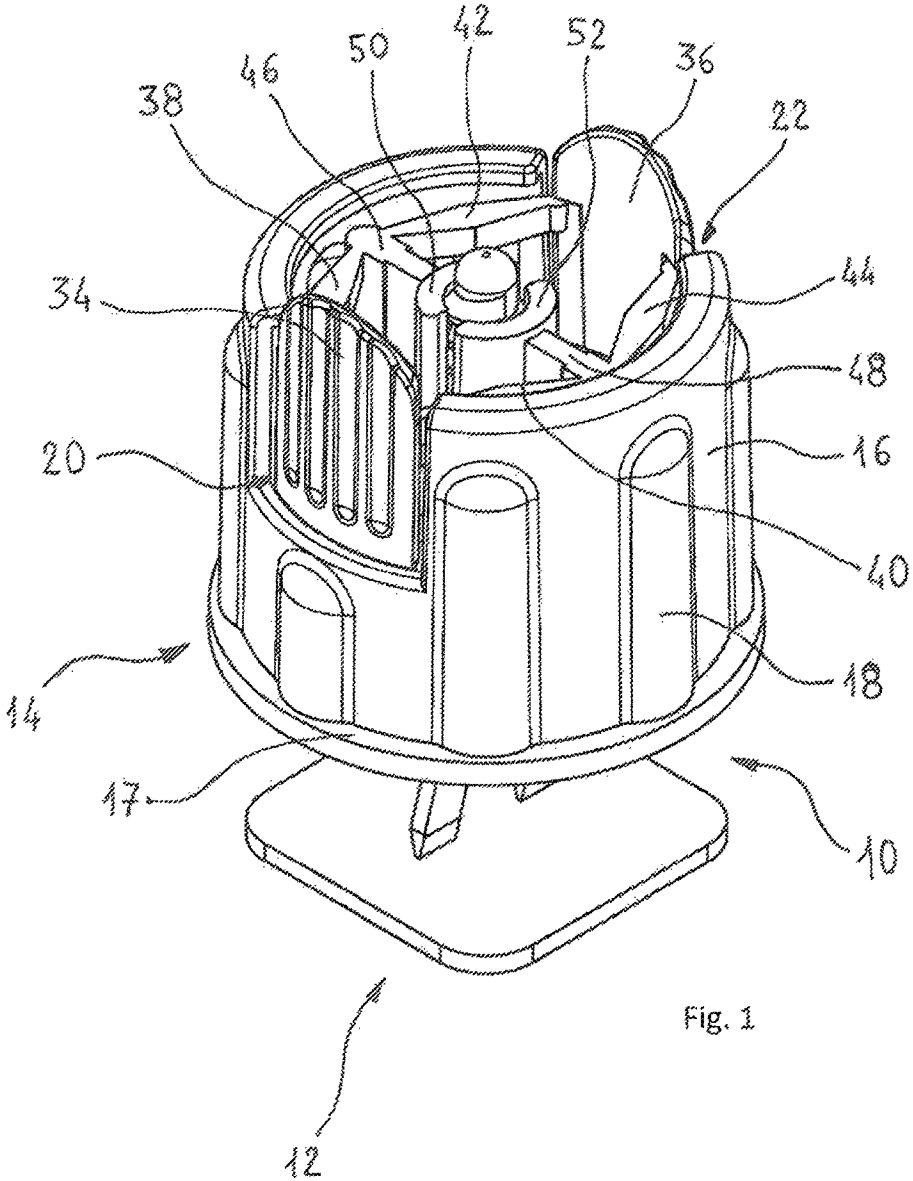
Figure 5:
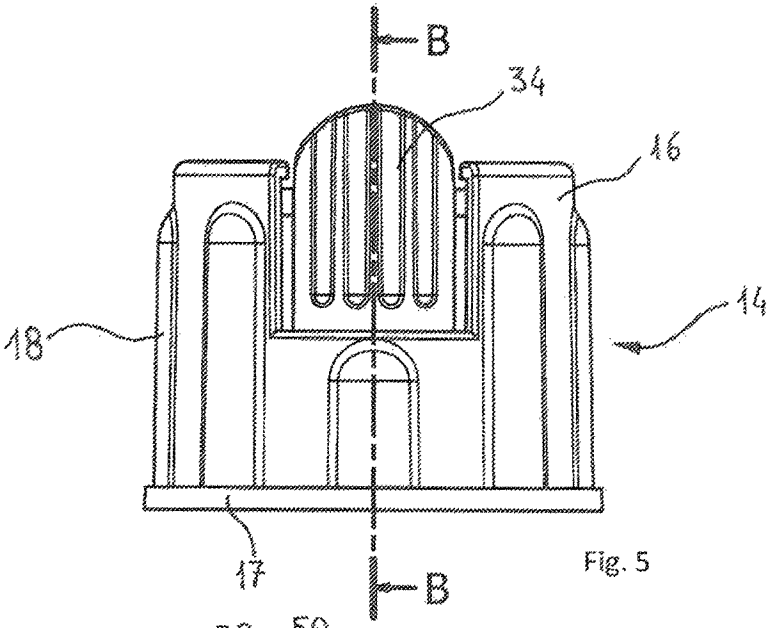
FIG. 5 is a side view of the element in FIG. 3.

As visible in FIG. 1, the first fin 34 and the second fin 36 are arranged in correspondence of a first opening 20 and a second opening 22, respectively.

The joining edge between the triangular portions 30, 32 and the respective fins 34, 36 has a reduced thickness so that it is possible to flex the fins 34, 36 with respect to the triangular portions. The fins 34, 36 have, therefore, an elastic behavior. In other words, it is possible to press the two fins 34, 36 inwards by pressing them with the fingers of a hand; when the fins are released, the fins return to their orthogonal position with respect to the triangular portions 30, 32.

A first arm 38 is joined integrally to a side edge of the first fin 34, while a second arm 40 is joined integrally to the opposite side edge of the same first fin 34.

Likewise, a third arm 42 is joined integrally to a side edge of the second fin 36, while a fourth edge 44 is joined integrally to the opposite side edge of the same second fin 36.

The ends of the first arm 38 and third arm 42, opposite to those of union with the fins 34, 36, are connected to a first cross member 46, and likewise, the ends of the second arm 40 and fourth arm 44 are connected to a second cross member 48.

The first cross member 46 is joined to a first arcuate body 50, while the second cross member 48 is joined to the second arcuate body 52.

A first counter-thread 54 is obtained on the first arcuate body 50, while a second counter-thread 56 is obtained on the second arcuate body 52.

The first counter-thread 54 and the second counter-thread 56 have the same thread pitch and are arranged with respect to each other so as to form an only continuous counter-thread.

The first arcuate body 50 and the second arcuate body 52 have an arcuate section and extend vertically in front of each other so as to form a circular threaded hole 29 the axis of which coincides with the axis of the cylindrical body 16 and which is open laterally, as shown in FIG. 7.

The joining portions between the arms 38, 40, 42, 44 and the fins 34, 36, and between the arms 38, 40, 42, 44 and the cross members 46, 48 have such a thickness that the joining portions can be flexed towards each other.

In this way, when the first fin 34 and the second fin 36 are pushed towards the inside of the cylindrical body 16, also the first arm 38 and the third arm 42 are moved towards the inside and push the first cross member 46 towards the outside of the same cylindrical body 16.

Likewise, by applying the same pressure on the first fin 34 and second fin 36, the second arm 40 and the fourth arm 44 are moved inwards and push the second cross member 48 towards the outside of the cylindrical body 16.

The displacements of the first cross member 46 and second cross member 48 cause the first arcuate body 50 and the second arcuate body 52 to move away from each other so as to enlarge the hole 29.

The configuration of the arms and cross members cause that the force to be applied on the fins for the mutual spacing of the two arcuate bodies is minimal.

Figure 4:
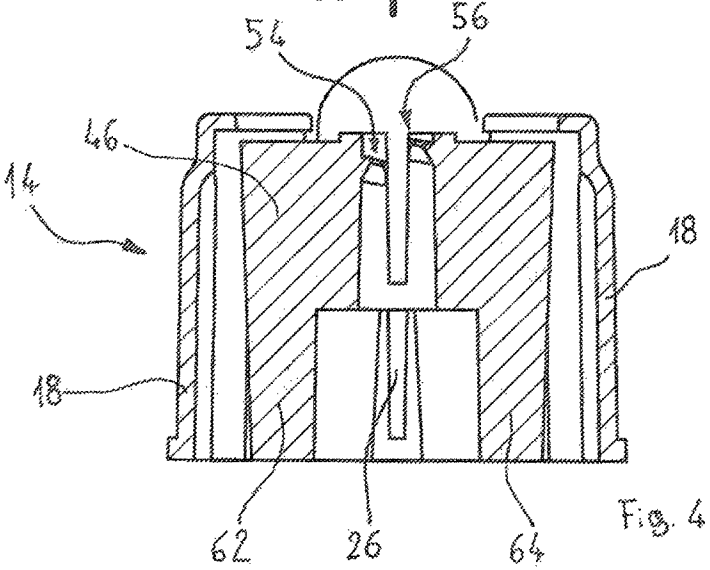
FIG. 4 is a view in section of the element in FIG. 3 according to plane A-A indicated in FIG. 3.
Figure 8:
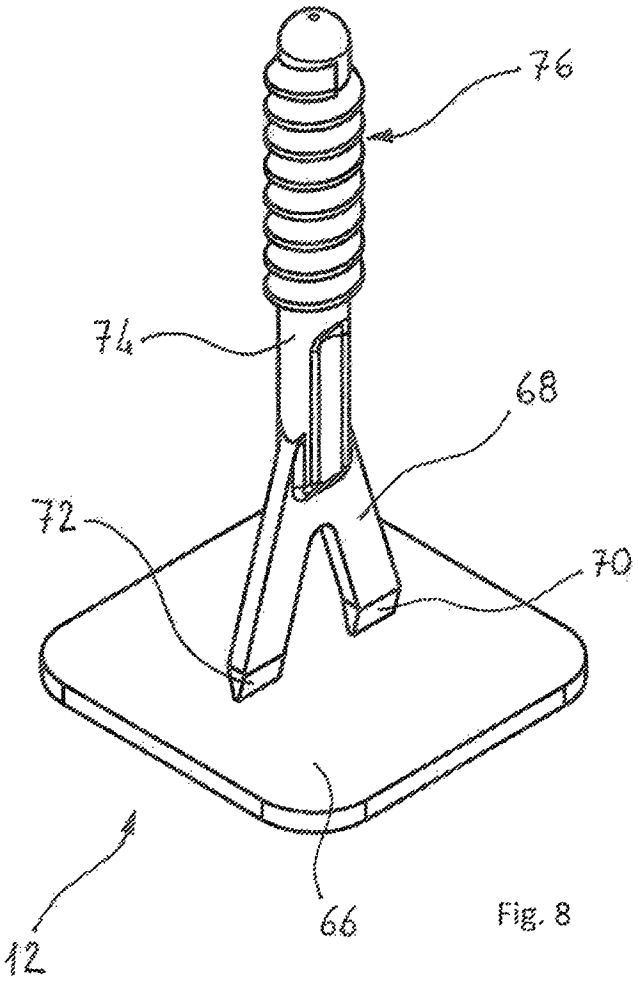
FIG. 8 is an axonometric view of a second element of the leveling device in FIG. 1.

As visible in FIGS. 2 and 4, a first half-cylinder 58 and a second half-cylinder 60 extend downwards from a support disk 28, also the half-cylinders having an axis coinciding with the central axis of the cylindrical body 16.

The first half-cylinder 58 and the second half-cylinder 60 are spaced apart so as to be crossed, without being touched, by the first shoulder 24 and the second shoulder 26.

Besides, a first projection 62 and a second projection 64 protrude radially from the first half-cylinder 58 and second half-cylinder 60, respectively and develop in height on the same first half-cylinder 58 and second half-cylinder 60.

The support 12 includes a base 66 from which a V-shaped portal 68 develops orthogonally, the portal being joined to the same base 66 through a first connecting portion 70 and a second connecting portion 72.

The first connecting portion 70 and the second connecting portion 72 taper towards the base 66 so as to obtain a reduced thickness in correspondence of the union to the same base 66.

An elongated body 74 extends from the portal 68. A thread 76 is formed on the elongated body 74 and is shaped in a homologous way to the first counter-thread 54 and second counter-thread 56 so that it is possible to couple, by screwing, the elongated body 74 to the hole 29 when the first arcuate body 50 and the second arcuate body 52 are adjacent.

Such position is realized in resting phase, that is, when the first fin 34 and the second fin 36 are not put under pressure.

On the contrary, when the first fin 34 and the second fin 36 are pressed inwards, the first arcuate body 50 and the second arcuate body 52 move away and allow to insert or remove the support 12 to or from the pressing body 14 inside the hole 29 without the need to screw or unscrew the same support 12.

The thread 76 as well as the first counter-thread 54 and the second counter-thread 56 have a reduced thread pitch so as to precisely adjust the position of the pressing body 14 with respect to the support 12.

The thread pitch of such threads may be included between 2 and 5 mm; in particular, the embodiment illustrated has a thread pitch of the threads equal to 3 mm.

Below, the use procedure of a leveling device 10 according to the invention is described.

Firstly, a first tile P is arranged in the desired position on an appropriate adhesive material that is laid on the screed.

Figure 9:
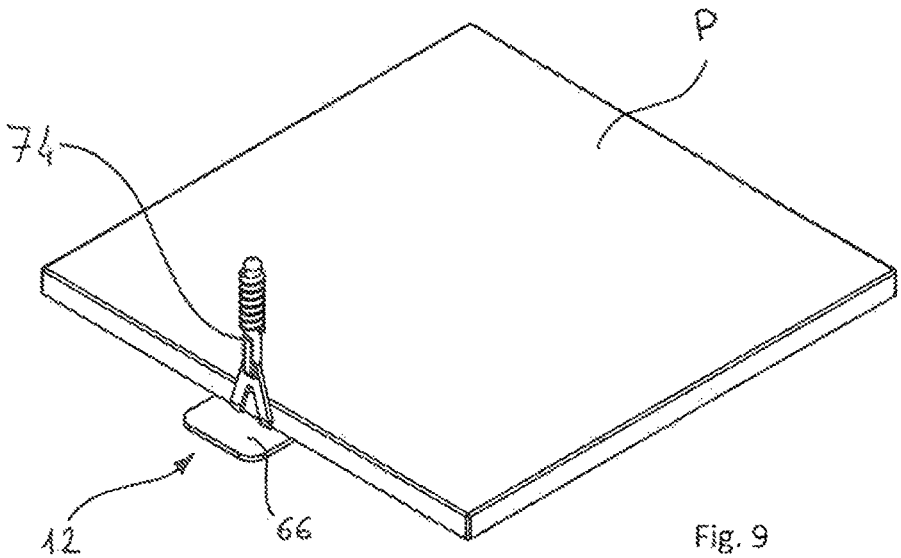
FIG. 9-12 are axonometric views showing the usage procedure to use a leveling device according to the invention.

As it appears from FIG. 9, a support 12 is then positioned in correspondence of a side edge of the same tile P, to which edge a second tile P' has to be leant, so that the base 66 of the same support 12 is positioned between the same tile P and the screed.

Figure 10:
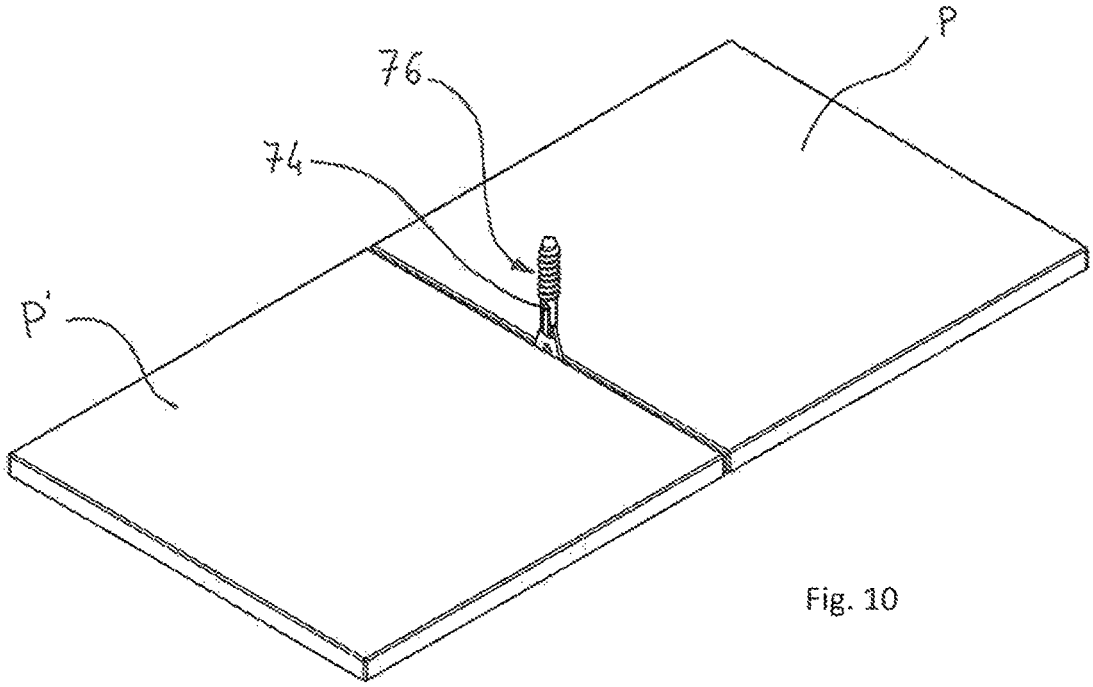

The second tile P' is placed on the adhesive material so as to be adjacent to the first tile P and is arranged on the base 66 as it appears from FIG. 10.

The elongated body 74 having the thread 76 protrudes between the two tiles P, P'. The distance between the two tiles is determined by the thickness of the portal 68, which determines the width of the tile joint.

Figure 11:
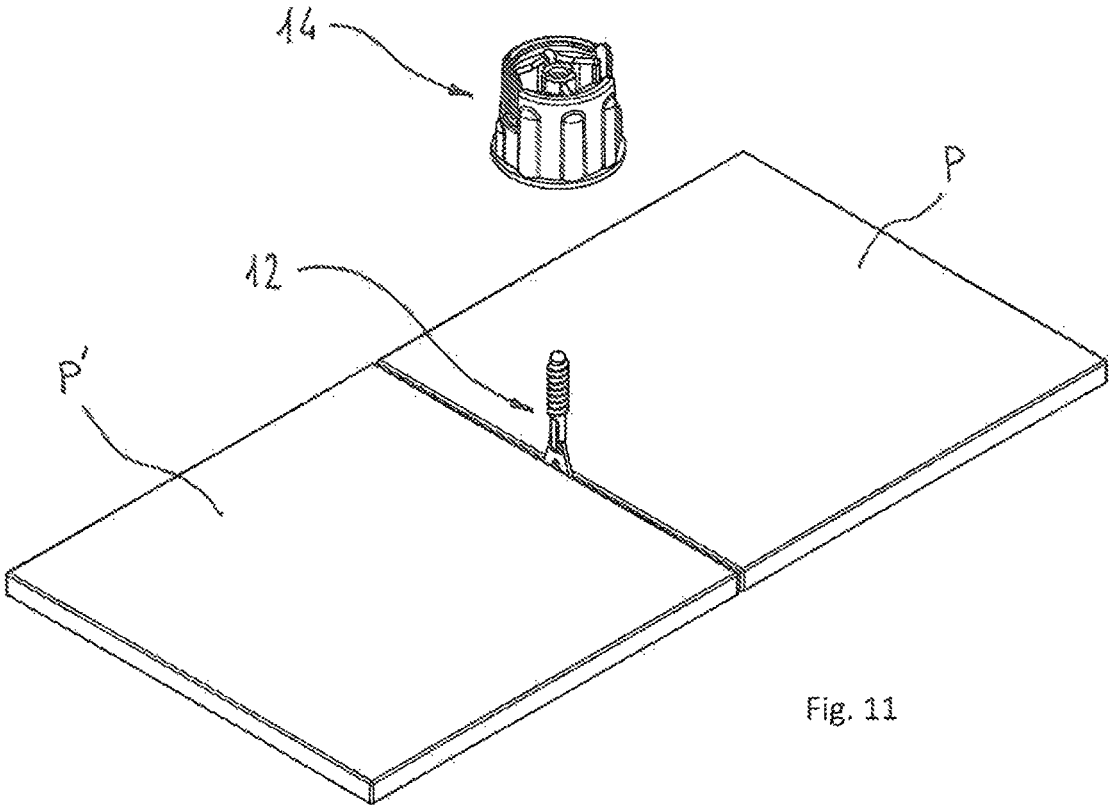

Subsequently, as shown in FIG. 11, the pressing body 14 is approached and coupled to the support 12 ensuring that the elongated body 74 of the support 12 is inserted into the hole 29 of the pressing body 14 until the lower edge 17 of the cylindrical body 16 is in abutment on at least one of the two tiles P, P'.

Such positioning can be done by screwing the pressing body 14 onto the support 12 without pressing on the first fin 34 and second fin 36.

Alternatively, the user can exert pressure on the two fins 34, 36 separating further the first arcuate body 50 and the second arcuate body 52 from each other and the user can insert the elongated body 74 into the enlarged hole 29 without having to rotate the pressing body 14 so that this operation is very rapid.

Figure 12:
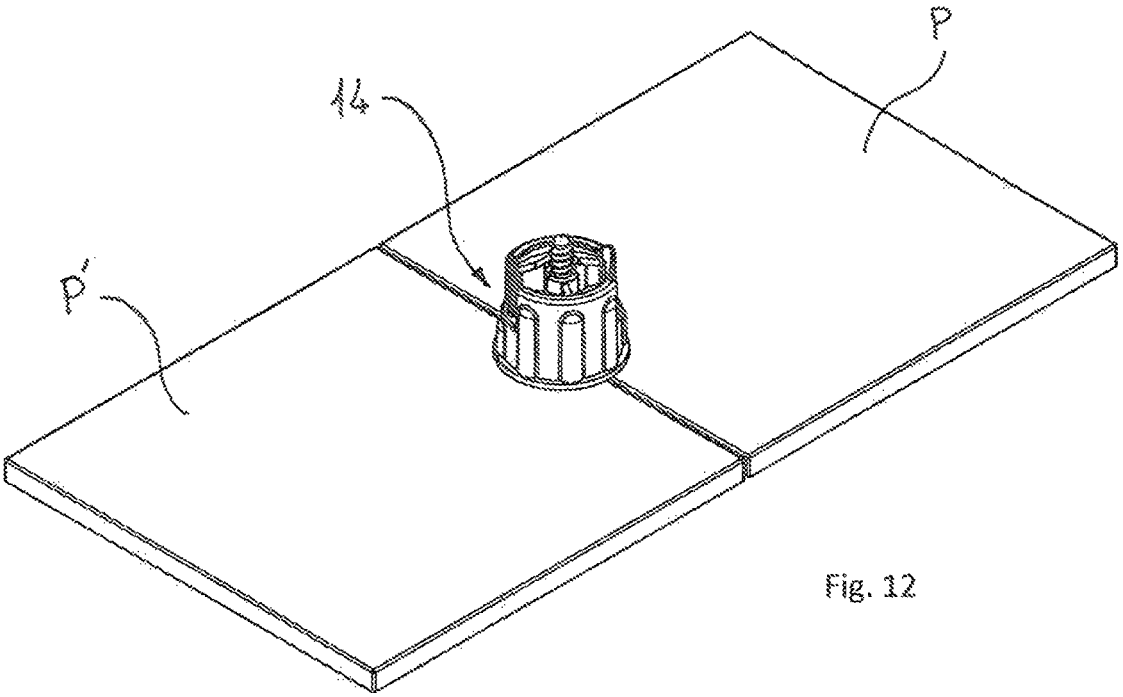

As shown in FIG. 12, once the pressing body 14 is in abutment on one of the tiles P, P', the user rotates the pressing body 14 taking hold of the same by means of the reliefs 18.

Doing so, the screwing of the pressing body 14 onto the elongated body 74 of the support 12 causes that the lower edge 17 pushes downwards the tile that is higher up.

The reduced thread pitch of thread 76, first counter-thread 54 and second counter-thread 56 allows to obtain a better adjustment and to press on the tiles without the user having to make a great effort to rotate the pressing body 14.

The user can terminate the screwing when the lower edge 17 is in abutment on both tiles P, P'.

Besides, also the first half-cylinder 58 and/or the second half-cylinder 60 along with the first projection 62 and/or the second projection 64, all these elements being arranged internally to the cylindrical body 16, will abut at first on one tile and then on both tiles P, P'.

As visible in FIG. 4, since the first half-cylinder 58 and the first projection 62 form an only body with the first cross member 46, the first arcuate body 50 is prevented from getting away from the elongated body 74 so that the two threads remain paired and the pressing body 14 can keep pushing on the tile that is higher up.

Likewise, since also the second half-cylinder 60 and the second projection 64 form an only body with the second cross member 48, the threads of the first arcuate body 50 and elongated body 74 are prevented from being decoupled.

When the edges of the two tiles P, P' are at the same level and the so-described operation has been performed for all the leveling devices arranged on the tiled surface under construction, it is necessary to let the adhesive material dry so that the tiles be stably fixed to the floor.

Then, the user removes the pressing body 14 and a part of the support 12 by acting with a kick or with a violent blow against the pressing body 14.

In fact, the impact on the pressing body 14 provokes the detachment of both the elongated body 74 and the portal 68, secured to the pressing body 14, from the base 66 that remains under the tiles P, P'.

This is possible because of the reduced thickness of the first connecting portion 70 and second connecting portion 72 which connect the portal 68 to the base 66.

Then, the several pressing bodies 14 used to lay the tiles can be recovered for a new utilization by separating them from the respective remained portions of the supports 12. Such separation can be made easily by pressing on the fins 34, 36 and removing the elongated bodies 74 and the portals 68.

Finally, there may be variants to be considered as included in the scope of protection of the present invention as defined by the following claims. For example, the leveling device according to the invention may include coupling means between the support and the pressing body, different from thread and counter-thread, such as a form coupling.

The invention claimed is:

1. Leveling device suitable for being used by a user for laying on a plane and leveling at least two adjacent tiles P, P', comprising:

a support suitable for being disposed between the at least two tiles P, P' and comprising:

a base suitable for being disposed under the at least two adjacent tiles P, P', an elongated body that extends orthogonally to the base and comprises first gripping means;

a pressing body with central longitudinal axis, suitable for being movably fastened to the support and comprising a bearing structure with a lower edge adapted to abut on at least one of the at least two tiles P, P'; a hole being formed in the bearing structure so as to receive the elongated body that can translate freely;

the pressing body further comprising:

at least one fin fixed elastically to the bearing structure and adapted to be pressed by the user so as to be moved from a rest position when the fin is not pressed to a release position when the fin is pressed;

at least one arcuate body fixed elastically to the bearing structure, connected to the at least one fin and including second gripping means;

the first gripping means and the second gripping means being shaped in a homologous way so as to be coupled with one another so that when the elongated body is inserted in the hole and the at least one fin is in a rest position, the at least one arcuate body abuts on the elongated body and couples the first gripping means and the second gripping means to one another so as to avoid a free translation of the pressing body relative to the support, and so that when the elongated body is inserted in the hole and the at least one fin is in the release position, the at least one arcuate body is moved away from the elongated body and the first gripping means and the second gripping means are not coupled to one another so as to enable the pressing body to freely translate relative to the support; wherein the first gripping means of the elongated body include a thread and the second gripping means of the at least one arcuate body include a counter-thread, homologous to the thread, so that the elongated body can be screwed and unscrewed in the at least one arcuate body.

2. Leveling device according to claim 1, wherein the pressing body includes a first fin and a second fin which are elastically fixed to the bearing structure and are arranged above opposite to each other with respect to the central axis of the pressing body.

3. Leveling device according to claim 2, wherein the pressing body includes a first arcuate body and a second arcuate body which are fixed elastically to the bearing structure and arranged opposite to each other with respect to the central axis of the pressing body.

4. Leveling device according to claim 3, wherein an end of a first arm and an end of a second arm are fixed to the first fin, and an end of a third arm and an end of a fourth arm are fixed to the second fin, the opposite end of the first arm and the opposite end of the third arm being joined together and to a first cross member fixed to the first arcuate body, the opposite end of the second arm and the opposite end of the fourth arm being joined together and to a second cross member fixed to the second arcuate body.

5. Leveling device according to claim 4, wherein the first cross member develops downwards by means of a first projection up to touch a first plane coplanar to the lying plane of the lower edge of the pressing body, and wherein the second cross member develops downwards by means of a second projection up to touch a first plane coplanar to the lying plane of the lower edge of the pressing body.

6. Leveling device according to claim 2, wherein the bearing structure includes a cylindrical body in whose upper portion a first opening and a second opening are formed in which the first fin and the second fin are arranged, respectively.

7. Leveling device according to claim 6, wherein at least one relief is disposed on the outer surface of the cylindrical body.

8. Leveling device according to claim 1, wherein the bearing structure includes a support disk disposed internally and at half height of the entire bearing structure, a first half-cylinder and a second half-cylinder extending downwards from the support disk up to touch a second plane coplanar to the lying plane of the lower edge of the pressing body.

9. Leveling device according to claim 1, wherein the elongated body is joined to the base through a portal that develops orthogonally to the base.

* * * * *